US009136629B2

(12) United States Patent
Holland

(10) Patent No.: US 9,136,629 B2
(45) Date of Patent: Sep. 15, 2015

(54) MOVING PART COAXIAL CABLE CONNECTORS

(71) Applicant: Michael Holland, Santa Barbara, CA (US)

(72) Inventor: Michael Holland, Santa Barbara, CA (US)

(73) Assignee: Holland Electronics, LLC, Ventura, CA (US)

( * ) Notice: Subject to any disclaimer, the term of this patent is extended or adjusted under 35 U.S.C. 154(b) by 15 days.

(21) Appl. No.: 13/913,487

(22) Filed: Jun. 9, 2013

(65) Prior Publication Data

US 2014/0024234 A1 Jan. 23, 2014

Related U.S. Application Data

(63) Continuation-in-part of application No. 13/911,032, filed on Jun. 5, 2013.

(60) Provisional application No. 61/673,356, filed on Jul. 19, 2012, provisional application No. 61/717,595, filed on Oct. 23, 2012.

(51) Int. Cl.

| | |
|---|---|
| ***H01R 9/05*** | (2006.01) |
| ***H01R 13/17*** | (2006.01) |
| ***H01R 43/26*** | (2006.01) |
| ***H01R 13/08*** | (2006.01) |
| ***H01R 24/52*** | (2011.01) |
| *H01R 13/453* | (2006.01) |
| *H01R 13/6581* | (2011.01) |

(52) U.S. Cl.

CPC ..... *H01R 13/17* (2013.01); *H01R 13/08* (2013.01); *H01R 24/525* (2013.01); *H01R 43/26* (2013.01); *H01R 13/4538* (2013.01); *H01R 13/6581* (2013.01); *Y10T 29/49208* (2015.01)

(58) Field of Classification Search

USPC ..... 439/578–585, 352, 357, 108, 131

See application file for complete search history.

(56) References Cited

U.S. PATENT DOCUMENTS

| | | | | |
|---|---|---|---|---|
| 4,660,921 | A | 4/1987 | Hauver | |
| 5,598,132 | A | 1/1997 | Stabile | |
| 5,820,390 | A | 10/1998 | Takamoto et al. | |
| 6,019,622 | A | 2/2000 | Takahashi et al. | |
| 6,270,367 | B1 | 8/2001 | Bussard | |
| 6,329,251 | B1 | 12/2001 | Wu | |
| 6,712,631 | B1 | 3/2004 | Youtsey | |
| 6,716,062 | B1 | 4/2004 | Palinkas et al. | |
| 7,753,705 | B2 | 7/2010 | Montena | |
| 7,934,954 | B1 * | 5/2011 | Chawgo et al. | 439/578 |
| 7,938,680 | B1 | 5/2011 | Hsieh | |
| 8,272,893 | B2 * | 9/2012 | Burris et al. | 439/578 |
| 8,556,656 | B2 * | 10/2013 | Thomas et al. | 439/584 |
| 8,602,818 | B1 * | 12/2013 | Chawgo et al. | 439/578 |
| 8,690,603 | B2 * | 4/2014 | Bence et al. | 439/583 |
| 8,708,737 | B2 * | 4/2014 | Chawgo et al. | 439/578 |
| 8,753,147 | B2 * | 6/2014 | Montena | 439/578 |
| 8,758,050 | B2 * | 6/2014 | Montena | 439/578 |
| 2011/0244720 | A1 | 10/2011 | Peng | |
| 2013/0102190 | A1 | 4/2013 | Chastain et al. | |

FOREIGN PATENT DOCUMENTS

| | | |
|---|---|---|
| EP | 1895625 A1 | 3/2008 |
| GB | 2314465 A | 12/1997 |

* cited by examiner

*Primary Examiner* — Jean F Duverne

(74) *Attorney, Agent, or Firm* — Paul D. Chancellor; Ocean Law

(57) ABSTRACT

A female F connector incorporates a nose protruding from an end of the connector and the nose is urged to protrude by a spring.

14 Claims, 16 Drawing Sheets

MOVING PART COAXIAL CABLE CONNECTORS

PRIORITY CLAIM AND INCORPORATION BY REFERENCE

This application is a continuation-in-part of U.S. patent application Ser. No. 13/911,032 filed Jun. 5, 2013 and entitled MOVING PART COAXIAL CABLE CONNECTOR which claims the benefit of U.S. Provisional Patent Application No. 61/717,595 filed Oct. 23, 2012 and entitled MOVING PART COAXIAL CABLE CONNECTOR FOR IMPROVED SIGNAL MANAGEMENT, both of which are incorporated herein in their entireties and for all purposes.

BACKGROUND OF THE INVENTION

1. Field of the Invention

The invention relates to articles of manufacture. In particular, a coaxial cable connector includes a moving nose urged from an opening at an end of the connector.

2. Discussion of the Related Art

In cable television and satellite television systems ("CATV"), signal management includes maintaining circuit continuity and reducing unwanted radio frequency ("RF") signals exchanged at coaxial cable connectors. Among other things, signal management therefore aims to improve signal transmission, to improve signal to noise ratio, and to avoid distortion associated with saturated reverse amplifiers and related optic transmission equipment.

Past efforts to limit interfering RF signals into CATV systems have been reported, including the efforts of this inventor. Solutions have included increased use of traditional connector shielding, multi-braid coaxial cables, connection tightening guidelines, increased use of traditional splitter case shielding, and high pass filters limiting low frequency spectrum signal ingress and interference with active home CATV systems.

While it appears the industry accepts the status quo as satisfactory, there remain, in the inventor's view, good reasons to develop improvements that further improve the shielding of coaxial cable connectors and in particular female F-Type connectors ("F" connectors).

In the inventor's view, all of poor signal transport through mated connectors, stray signal ingress into mated or open connectors, and signal emission from mated or open connectors represent potential problems.

Stray RF signals can cause problems in CATV systems such as home CATV systems. For example, when a subscriber leaves a CATV connection such as a wall-mounted connector or coaxial cable drop connector disconnected/open, an unprotected stray signal ingress point is created. The open connector end exposes a normally metallically enclosed and shielded signal conductor and can be a significant source of unwanted RF ingress alone, or in the aggregate with other signal ingress locations.

F connectors are commonly used in the United States for interconnecting cable and satellite television equipment in the home. Wall mounted female F connectors and/or coaxial cable "drop(s)" including a male F connector commonly supply a signal to the TV set, cable set-top box, or internet modem. Notably, wall mounted female F connectors are commonly connected via a coaxial cable terminated with male connectors at opposite ends.

Whether a CATV signal is supplied to equipment via a drop cable or via a wall mounted connector, this connection is a potential source of unwanted RF signal ingress. Wall mounted connectors left open or coaxial cables attached to the wall mounted connector but otherwise open are points of unwanted RF signal transfers. Similarly, drop cables such as those terminated with a male F connector become unwanted RF signal transfer points when left open.

Multiple CATV connections in a home increase the likelihood that some connections will be left open and/or unprotected, making them, for example, a potential source of unwanted RF ingress. And, when subscribers move out of a home, CATV connections are typically left open, another situation that creates undesirable RF signal transfer points with the CATV distribution system.

A known method capable of eliminating unwanted RF ingress in a CATV system involves the use of metal end caps to cover unused F connectors in the home or, to place a single metal cap over the feeder F connection at the home network box. But, in the usual case home CATV connections are left active and open, an undesirable but accepted practice the industry tolerates to avoid expensive service calls associated with new tenants and/or providing the CATV signal in additional rooms.

The inventor's experience shows current solutions for reducing unwanted RF ingress resulting from open connectors are not successful and/or are not widely used. Therefore, to the extent the CATV industry recognizes a need to further limit interfering RF ingress into CATV systems, it is desirable to have connectors that reduce unwanted RF signal transfers when connections coupled to the CATV system are left open.

Points of unwanted RF signal transfer are created by loosely mated connectors. In particular, loose connectors typically have gaps in the electromagnetic containment intended to enclose signal conductors and to prevent unwanted signal ingress. These gaps also interrupt ground path circuits. Here, ingressing signals travel in gaps between connector parts such as a gap between the nut and mandrel flange resulting from a loose fitting nut. Notably, in some recent male F connectors this problem is resolved or mitigated using a supplemental spring contact to either electrically interconnect open electrical contacts or provide an axial spring force to push the nut against the connector mandrel flange. (See, for example, U.S. Pat. Nos. 6,712,631, 6,716,062, and 7,753,705.) Some others utilize a spring located behind the male connector nut. One solution (i.e. U.S. Pat. No. 6,712,631) uses a split washer as a spring to mitigate the problem.

Notably, while the signal ingress problem has received some attention in the cable television industry, prior art solutions have relied on modifications made to the male F connector, not modifications made to the female F connector. Further, known solutions do not mitigate the problem of undesirable RF signal transfers via loose nut threads.

The present inventor knows of no F connector ingress reduction solutions teaching and relying on modifications of the female connector. And, while moving part activators have uses in shunt switches and clamps, these devices are unlike embodiments of the present invention.

Known signal ingress solutions also do not generally teach urging 360 degree contact between a nut rim and mandrel flange to create an RF barrier. In particular, references using moving parts were designed and used for purposes other than meeting the RF shielding needs of present-day CATV service providers.

Some references use moving insulators. However, these references differ from the present invention because they fix the connector center conductor to an activation mechanism. For example, U.S. Pat. Nos. 4,660,921 and 5,598,132 use a moving center pin attached a moving insulator. Among other things, this design is not applicable to device mounted connectors and is unreliable because of uncertain contact with a center conductor. Notably, installers hand-craft coaxial cable center conductor lengths and, where too short, these lengths fail to contact the moving center pin.

U.S. Pat. No. 6,270,367 requires a center conductor coiled into a spring and acting as a series inductor. As skilled artisans will appreciate, such structures are generally ill suited to high frequency operations including frequencies over 20 MHz, a limitation far short of present day gigahertz requirements.

U.S. Pat. No. 6,329,251 discloses the center conductor of the connector as an operational component in transferring forces. Such a design compromises the connector conductive center pin and compromises RF performance due to the larger size center pin required.

U.S. Pat. No. 7,938,680 (the "'680" patent) includes a continuity spring forward of the front ferrule face with its contact point facing radially inward against the female body but enclosed in a tube extended from the forward part of the ferrule post. In the '680 patent, the approach to resolving the electrical continuity problem while avoiding the disadvantage of other spring loaded designs is to extend a sleeve attached to the post forward end where an inward connection spring is located. This would electrically connect the spring to the tube via contact with the outer sleeve. But, this approach also has disadvantages. For example, there is a need for an expensive, very large outer nut to contain the new internal sleeve. In addition, the F connector tightening tools and industry specifications generally require a standard hex nut with an 11 mm hex-hex dimension, requirements that are not possible with this inner sleeve design.

Each of U.S. Pat. Nos. 7,938,680, 6,712,631, 6,716,062, 7,753,705, 4,660,921, 5,598,132, 6,270,367, and 6,329,251 is incorporated herein by reference in its entirety and for all purposes.

The interface between male and female coaxial connectors requires good contact of the outer shield in order to both transport the RF signals with integrity and to prevent unwanted signal ingress. These goals are served in a variety of ways with RF coaxial connectors. One method used on BNC connectors is to spring load the grounding components on male and female connectors. Another method uses threaded male female interfaces and precise tightening specifications to set torque levels insuring proper operation. Industry experience shows maintenance of required RF performance using this method requires both a high level of installation craft sensitivity as well as suitable environmental conditions such as environments free of vibration and excessive temperature changes. But, F type coaxial connectors are used in consumer applications where there is no assurance the user will follow difficult or even any particular installation specifications. Therefore a need exists for F connectors that insure proper electrical continuity despite a loosened male connector nut.

Male F type coaxial connectors typically use an internally threaded nut to connect the male connector with a female connector having corresponding external threads. In various examples, tightly mated connectors maintain a good connection from the coaxial cable outer ground/shield and a male connector ferrule tube/post to the female connector outer body. But, if the male nut is not fully tightened to the female connector, the ground connection between the cable and a connected device/cable may be faulty. Known methods remedying the loose connector nut problem frequently include a spring behind a male connector mandrel flange to spring the flange against the female connector end-face. Solutions of this sort suffer a disadvantage when the cable is off-axis due to a loose nut since the expected parallel interface planes which compromises conductivity.

SUMMARY OF THE INVENTION

The present invention includes a spring activated protruding nose for urging engaged coaxial connectors apart for improving electrical continuity in a mated connector ground path.

In an embodiment, a female F connector improves mated connector ground path continuity, the female F connector comprising: a connector body and a connector body cavity extending between opposed first and second ends of the connector body; a conductive center pin located along a centerline of the connector body; a nose having a protruding nose portion that, absent external forces, extends from an aperture in the first end of the connector body; a spring that urges the extension of the protruding nose portion; the nose having a nose cavity extending between opposed first and second ends of the nose; an end of the conductive center pin slidingly engaged with the nose cavity; and, wherein the female F connector nose is operable to urge the separation of a mated male F connector such that mating of male and female connector ground path parts is improved.

And, in some embodiments, the connector above includes a conductive pin fixing structure for preventing relative motion between the pin and the female F connector body. In an embodiment of the above connector, a cylindrical structure and a pin mouth make up all or a portion of the conductive center pin. And, in an embodiment of the above connector, the cylindrical structure is concentric about a line whose length is the shortest distance between its end points.

In an embodiment, a method of mating coaxial connectors for improving continuity and electromagnetic shielding comprises the steps of: providing a female connector body with a central cavity extending between first and second ends of the body; extending a nose from a first end of the body; biasing the nose to extend from the body; engaging the body with a mating male connector; reducing a gap between the connectors by advancing a nut of the male connector on the female connector; the extended nose urging separation of the mated connectors; wherein the separation urged improves electrical contact between mated connector parts included in the ground path of the mated connectors; and, wherein the separation urged tends to close gaps in the containment enclosing the central signal path of the mated connectors.

In an embodiment, a moving part coaxial cable connector comprises: a hollow connector body with first and second ends; an aperture at the connector body first end; a nose urged to project from the aperture by a nose projecting spring; the nose movable in the aperture according to external forces; a conductive center pin and an adjoining pin mouth end, the pin mouth end slidably inserted in a central passageway of the nose; an electromagnetic shield incorporated in the nose; and, wherein one or more connector center conductors are shielded when the connector is unmated and the nose is free to project from the aperture. As used herein, either of hollow and bore refer to a hollow, a bore, a cavity, a space, and the like.

And, in an embodiment, a moving part coaxial cable connector comprising: a hollow connector body with first and second ends; an aperture at the connector body first end; a nose urged to project from the aperture by a spring; the spring having a design and spring constant able to project the nose when the connector is not mated; the spring having a design and spring constant able to mate connector ground path parts when the connector is mated; the nose movable in the aperture according to external forces; a conductive center pin and an adjoining pin mouth end, the pin mouth end slidably inserted in a central passageway of the nose; an electromagnetic shield incorporated in the nose; wherein when the connector is unmated, one or more connector center conductors are shielded when the nose freely projects from the aperture; and, wherein when the connector is mated, the nose is operable to urge the separation of a mated male F connector such that mating of connector ground path parts is improved.

BRIEF DESCRIPTION OF THE DRAWINGS

The present invention is described with reference to the accompanying figures. These figures, incorporated herein and forming part of the specification, illustrate the present invention and, together with the description, further serve to explain the principles of the invention and to enable a person skilled in the relevant art to make and use the invention.

DETAILED DESCRIPTION OF THE PREFERRED EMBODIMENT

The disclosure provided in the following pages describes examples of some embodiments of the invention. The designs, figures, and descriptions are non-limiting examples of certain embodiments of the invention. For example, other embodiments of the disclosed device may or may not include the features described herein. Moreover, disclosed advantages and benefits may apply to only certain embodiments of the invention and should not be used to limit the disclosed inventions.

Figure 1:
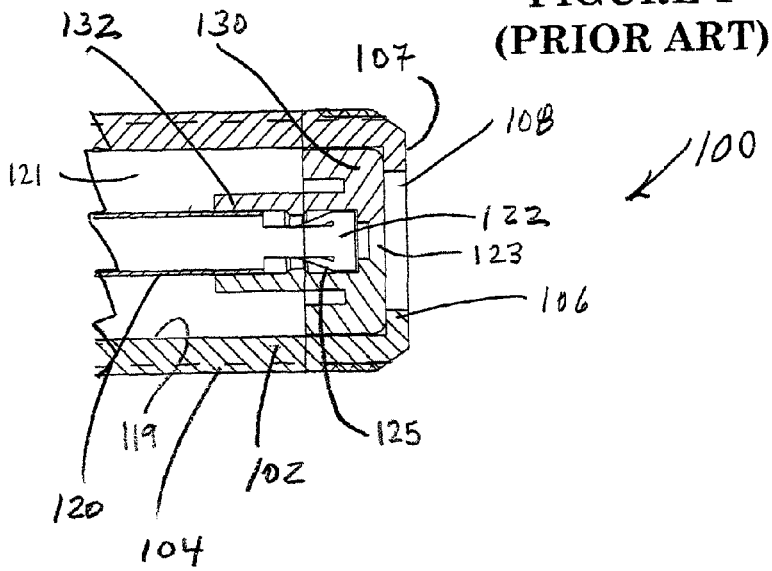
FIGURE 1 (PRIOR ART)
FIG. 1 shows a portion of a prior art female F connector.

FIG. 1 shows a prior art female portion of an F coaxial cable connector ("F connector") 100. This connector portion includes a connector body 102, a conductive pin 120 with a pin mouth 122, and a pin mouth insulator 130 for locating the pin mouth 122 about centrally in a connector body cavity 121

The body cavity 121 has a body inside wall 119 that encircles the insulator 130. In various embodiments the insulator is retained within the cavity by a female end rim 106 that presents a female end-face 107. Body attachment means such as threads encircling the body 104 provide for engaging a male connector (discussed below) with the female connector.

The conductive pin 120 is received by a socket of 132 of the insulator 130 such that the pin mouth 122 is accessible via an insulator mouth 123 near the body mouth 108. In an embodiment the pin mouth is integral with the conductive pin and in an embodiment the pin mouth is not integral with the conductive pin. In various embodiments the pin mouth is adapted to receive a central conductor of a coaxial cable (not shown) and to provide for electrical contact with the central conductor using contact(s) such as pin mouth tines 125.

Figure 2:
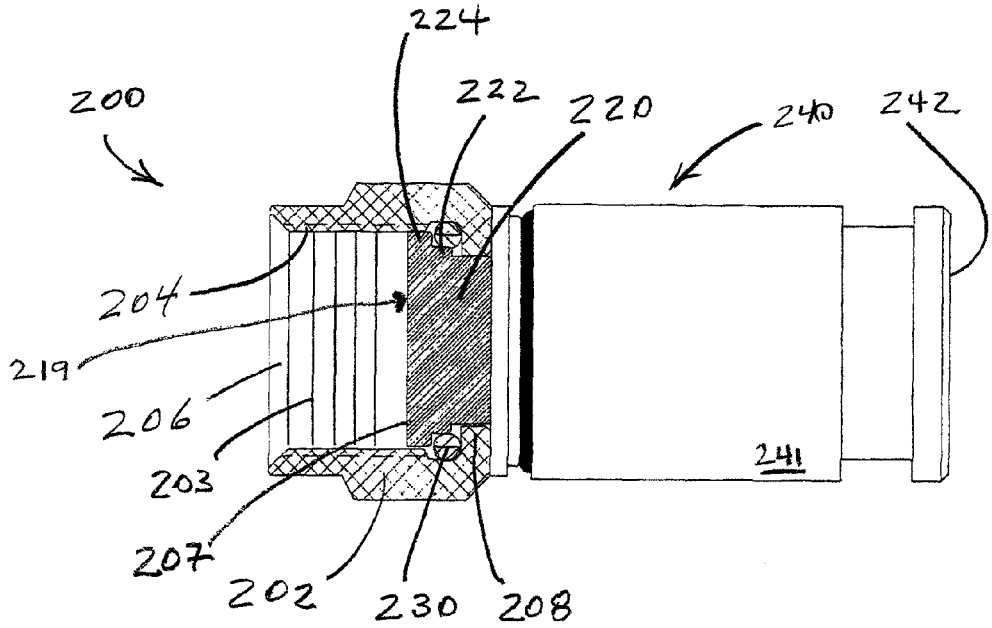
FIGURE 2 (PRIOR ART)
FIG. 2 shows a prior art male F connector.

FIG. 2 shows a prior art male F connector 200. A central mandrel 219 engages each of a nut 202 and an outer sleeve 241. An installed coaxial cable (not shown) enters an outer sleeve mouth 242 and a coaxial cable enter conductor extends from the mandrel 219 and through the nut 202.

The mandrel 219 includes a flange 224 and a shank 220 with a shoulder 222 there between. A trailing rim of the nut 208 encircles the mandrel shank and provides a rotatable engagement between the nut 202 and the mandrel. In some embodiments, an O-ring within the nut provides a means for sealing between the nut and the mandrel.

The nut includes means for engaging a female F connector. In an embodiment (as shown), a nut mouth 206 provides female F connector access and nut internal threads 203 provide for female F connector engagement. As further described below, the mandrel flange 224 presents a flange end-face 207 that is for engaging the female F connector end-face 107.

Figure 3A:
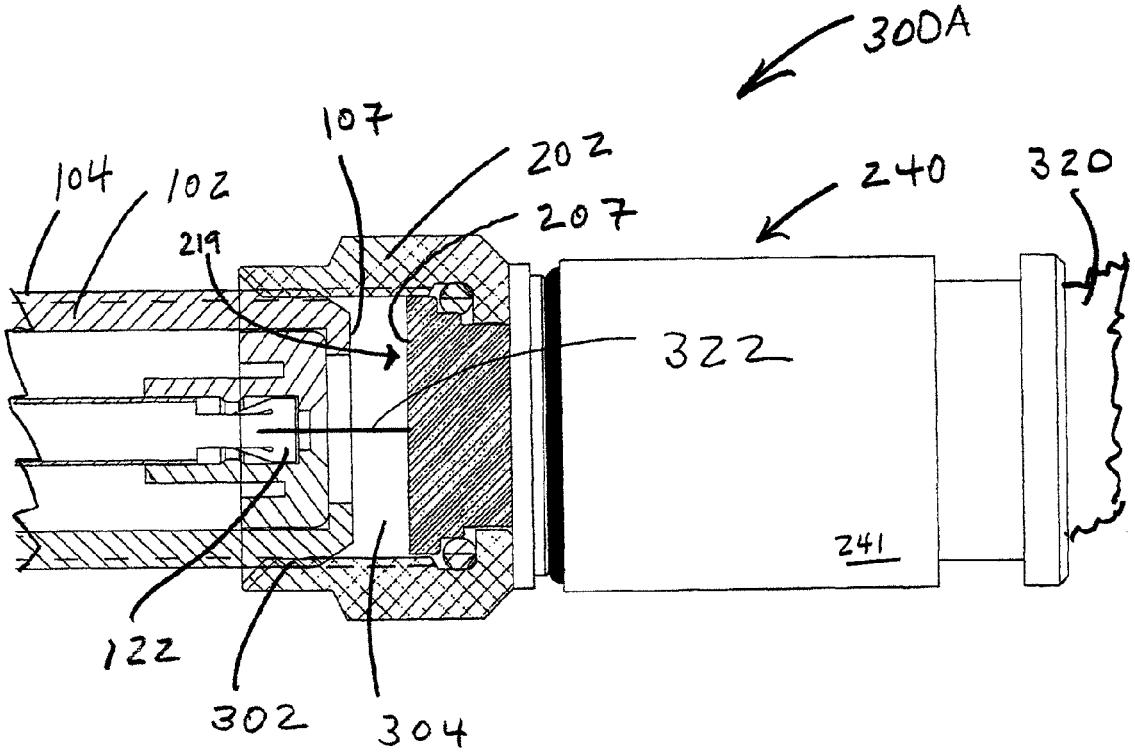
FIGURE 3A (PRIOR ART)
FIG. 3A shows a first example of mated prior art F connectors.

FIG. 3A shows the F connectors of FIGS. 1 and 2 when they are engaged, but incompletely mated 300A. In this figure, the male F connector 200 is installed on a coaxial cable 320 such that a ground sheath of the coaxial cable (not shown) makes electrical contact with the mandrel 219 and a center conductor of the coaxial cable 322 makes electrical contact with the pin mouth 122. As persons of ordinary skill in the art will appreciate, the mandrel provides a part of an outer electrical path through the connectors and the pin mouth provides a part of an inner electrical path through the connectors.

The outer electrical path includes the coaxial cable ground sheath, the mandrel 219, the nut 202, and the female F connector body 102. As seen, the nut extends between and engages each of the body and the mandrel. In particular, nut internal threads 204 and body external threads 104 provide a means for engaging and disengaging the nut and the body 102 while the nut trailing rim 208 rotatably engages the mandrel.

Skilled artisans will recognize that electrical continuity along the outer electrical path is affected by the thread/thread engagement 302, a nut rim/mandrel engagement 308, 219, and a mandrel flange end-face/body end-face engagement 207, 107.

Figure 3B:
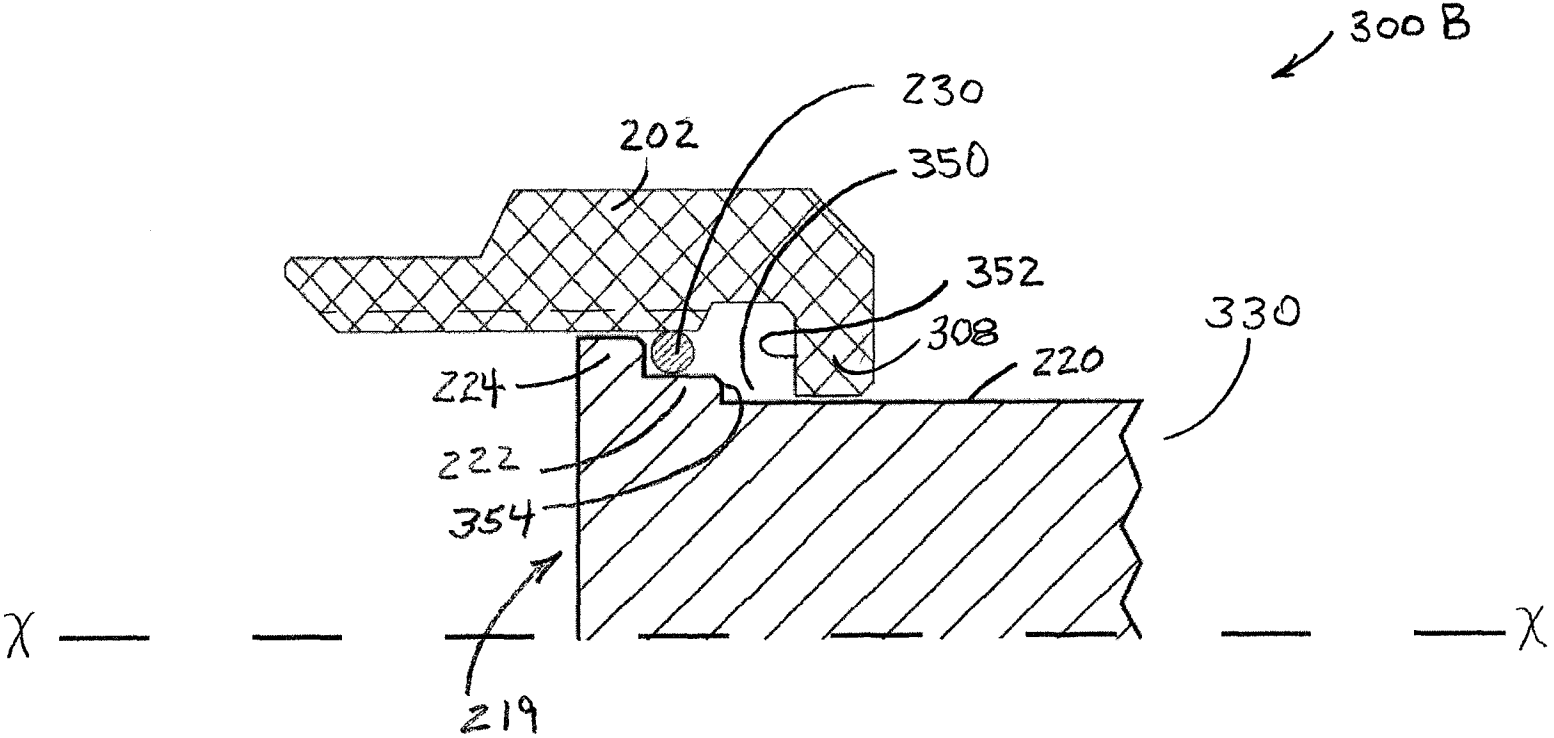
FIGURE 3B (PRIOR ART)
FIG. 3B shows an enlarged view of a portion of a prior art male F connector.

FIG. 3B shows an enlarged view of the nut rim/mandrel engagement 300B. As seen, a rim front-face 352 is opposite a mandrel shoulder back-face 354. As the nut 202 moves away from the shank trailing end 330, the nut rim to shoulder gap 350 is reduced until the rim front-face engages the shoulder back-face. In various embodiments, nut and mandrel 219 geometries differing from the geometry of FIGS. 3A,B provide a similar engagement means, such as an angled, irregular, and/or stepped engagement, that is operated by motion of the nut relative to the mandrel.

As will now be appreciated, to the extent the nut 202 is loose, the electrical ground path between the mated connectors 100, 200 may be attenuated, disrupted, interrupted, and/or otherwise faulty, with deleterious effects on signal transmission.

Figure 4:
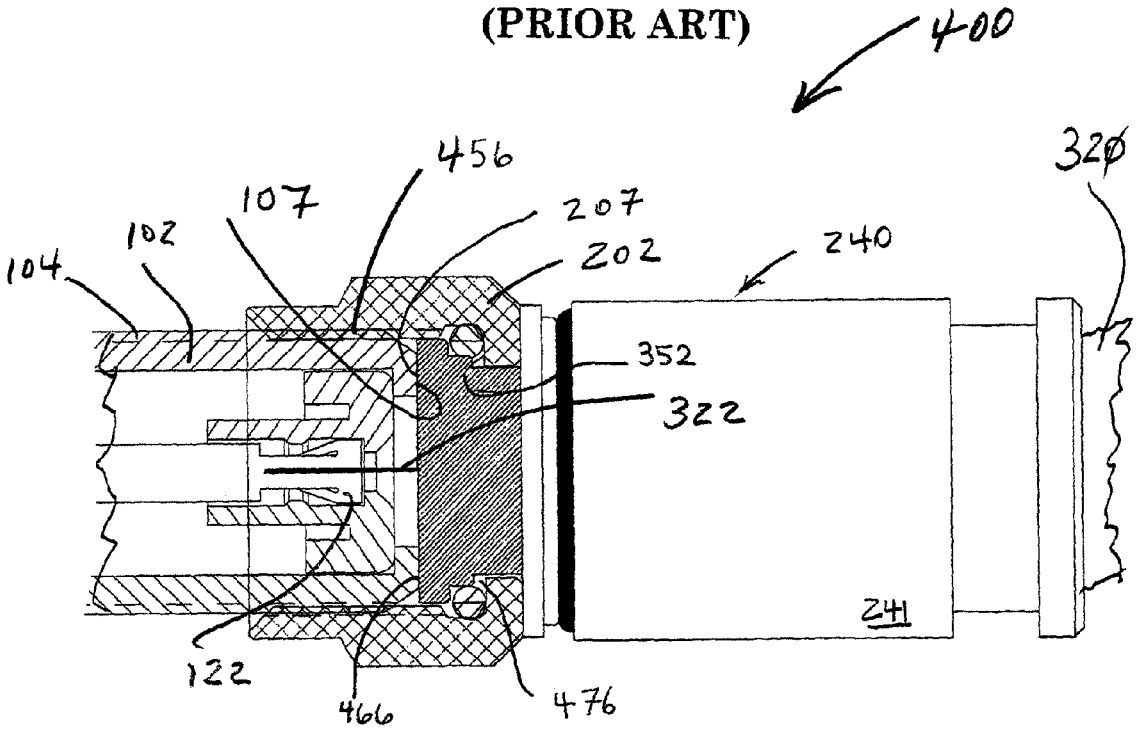
FIGURE 4 (PRIOR ART)
FIG. 4 shows a second example of mated prior art F connectors.

FIG. 4 shows the prior art F connectors of FIGS. 1 and 2 when they are engaged and completely mated 400. Here, the nut 202 is advanced onto the F connector female body 102 sufficiently to bring the flange end-face 207 into contact with the generally opposed body end-face 107 as the nut rim front-face 352 tugs against the mandrel shoulder back-face 354.

In various embodiments, electrical conductivity engagements in the completely mated connectors include a nut-thread/body-thread engagement 456, a body end-face/mandrel flange end-face engagement 466, and a mandrel shoulder back-face/nut rim front-face gap or engagement 476. These can be referred to as the 1) thread/thread engagement, 2) end-face/end-face engagement, and 3) back-face/front-face engagement.

As seen, the prior art F connectors of FIGS. 1,2 rely on fully engaging a male connector nut 202 with a female connector body 102 to assure the connectors are completely mated. To the extent a male connector nut loosely engages a female connector body, only a thread/thread engagement 456 may exist while a first gap 304 separates the body end-face 107 from the flange end-face 207 and a second gap 350 separates the mandrel shoulder back-face 354 from the nut rim front-face 352.

Figure 5A:
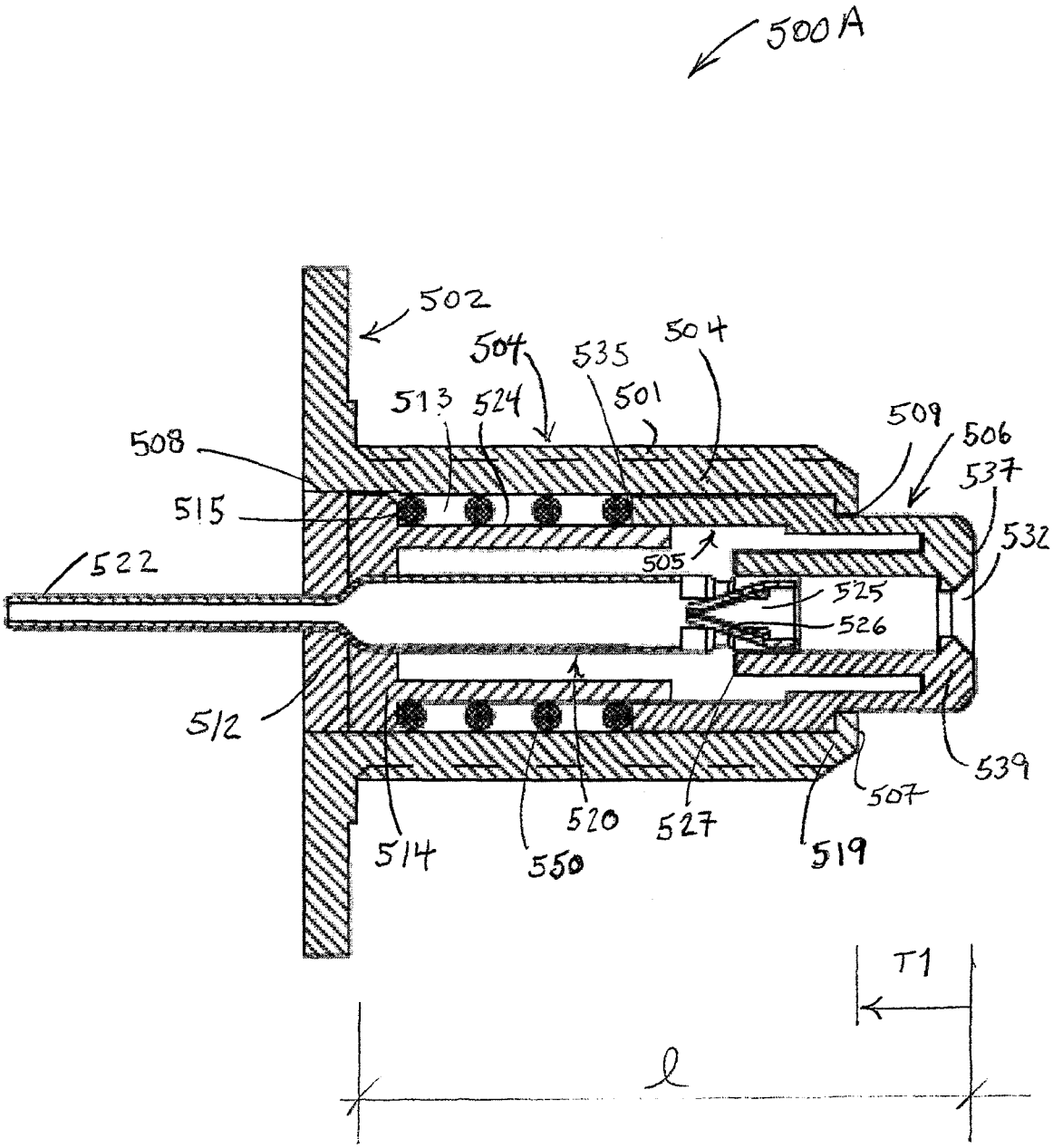
FIGS. 5A-D show a female F connector port in accordance with the present invention.
Figure 5B:
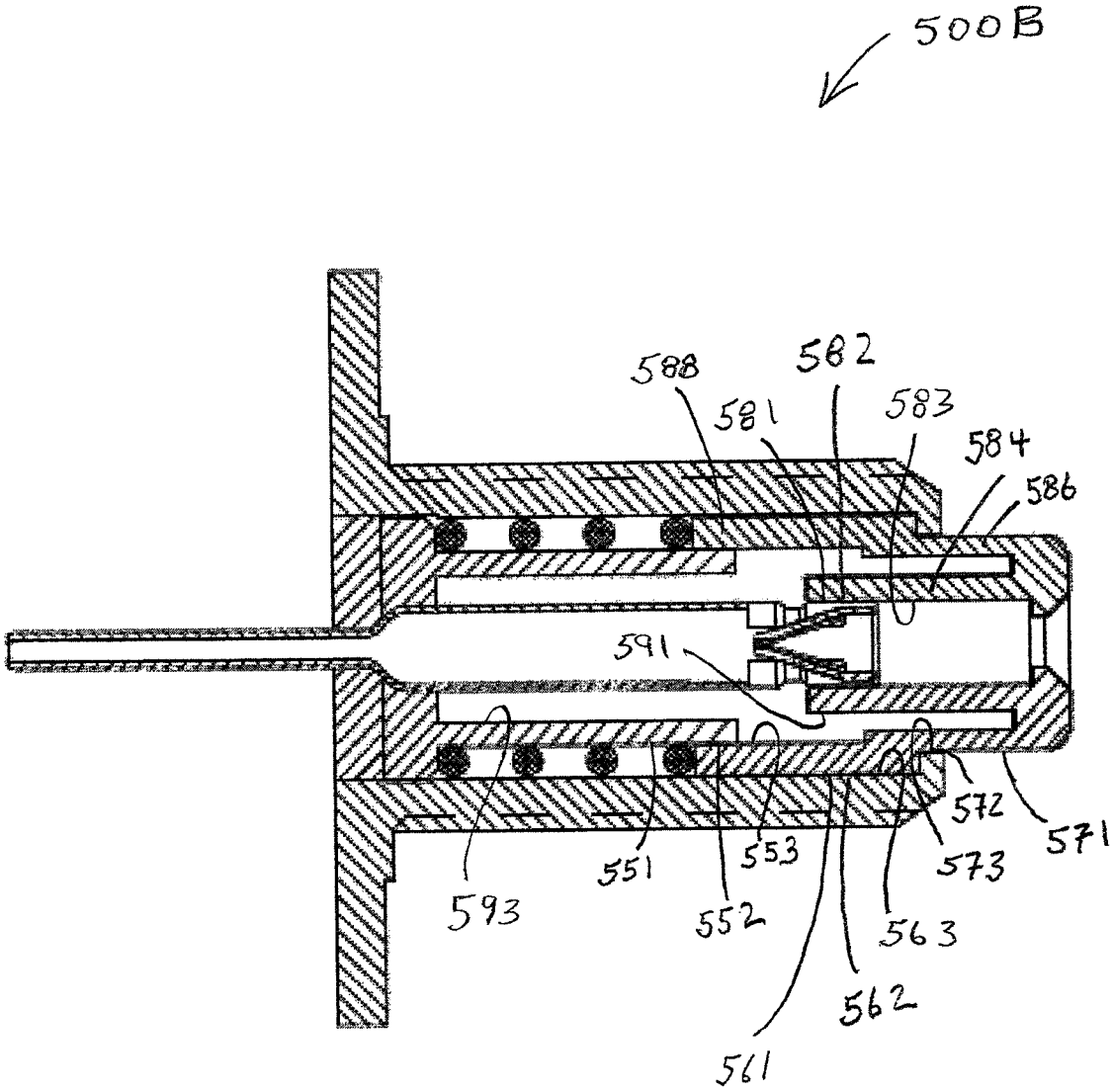

FIGS. 5A, 5B show a female F connector port with a spring activated nose 500A, 500B. A body 504 with external threads 501 extends from a connector base 502 and a moveable nose 506 protrudes 539 from a body cavity 513 at a body forward end 519.

Within the body 504 is a trailing portion of the nose 505 and a stand 514. The trailing portion of the nose slidably and/or telescopically engages the stand. In some embodiments, a base retainer 512 is inserted 508 in the body cavity 513, for example to position the stand 514. An elastic medium and/or device 550 tends to push the nose 506 away from the base 502 such that a protruding portion of the nose 539 extends from an aperture 509 at the body end face 507. The elastic medium or device can be any devise suited to the application such as a coil spring, compressible spring, elastic material, elastomeric band, gas filled device, or the like (referred to here as a "spring"). In an embodiment, the elastic medium or device is a compressible spring.

In an embodiment, the spring 550 encircles a stand periphery 524 such that it is between a nose rear-end 535 and a stand shoulder 515. Centrally mounted within the body 504 is a conductive pin 520 having a forward pin mouth 525 with tines 526 and a trailing post 522 extending through the stand 514 and the base retainer 512, if any. A nose passage in the protruding nose 532 enables a coaxial cable center conductor (not shown) to access the pin mouth. The pin mouth is slidingly inserted in a central socket of the nose 527 such that relative motion between the nose and the conductive pin occurs when the protruding nose 539 is pushed toward the base 502. Notably, the distance between the nose end-face 537 and the base 502 (representing a connector length l) is reduced when the spring 550 is compressed up to a distance T1.

In various embodiments, the nose 506 includes trailing walls such as a concentric short radius wall 584, mid radius wall 586, and long radius wall 588 forming portions of a plurality of sliding joints. For example plural of the following joints are formed in related embodiments. A forward joint 572 is formed between the mid-radius wall OD (outside diameter) 571 and a body forward end aperture lip 573. An inner central joint 582 is formed between the short radius wall ID (inside diameter) 583 and an outer surface of the pin mouth 581. An outer central joint 562 is formed between the long radius wall OD 561 and an inside wall of the body 563. A rear joint 552 is formed between the long radius wall ID 553 and a stand wall outer surface 551. An intermediate joint is formed between the mid radius wall OD 591 and an ID of the stand wall 593. As seen, a plurality of joints can be formed including: forward, inner central, outer central, rear, and intermediate joints.

As discussed in connection with FIG. 7 below, spring action of the nose urges mated connectors apart which tends to better bring mated threads into contact and to close gaps in connector parts such as gaps between a connector fastener/nut and a connector post flange. These actions are aimed at improving electrical continuity of the connector ground path and improving the electromagnetic containment and or shielding of the coaxial cable and connector center conductors.

Figure 5C:
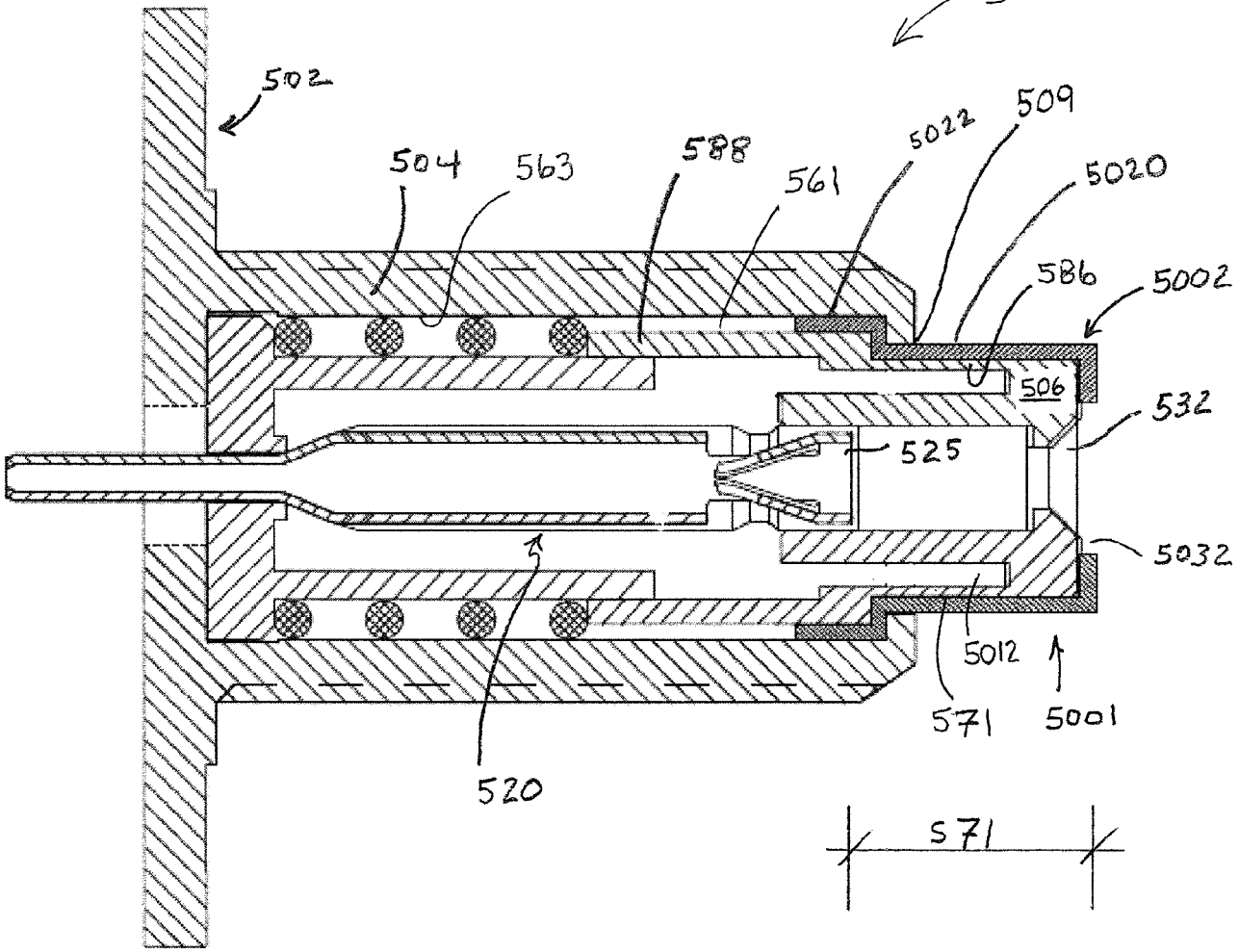

FIG. 5C shows 500C an enhanced version of a female F connector port of FIG. 5B. Here, embodiments of a nose assembly 5001 are configured to enhance electromagnetic shielding of center conductors.

In various embodiments, the nose assembly 5001 provides one or more of a) a nose 506 wholly or partially made from a material formulated to provide electromagnetic shielding, b) a nose 506 having an annular pocket 5012 surrounding connector and/or cable central conductor(s), the annular pocket containing an electromagnetic shielding material, and c) a nose 506 having a partial, substantially complete or complete outer covering that is an electromagnetic shield.

Embodiments include nose assemblies 5001 having a nose 506 wholly or partially made from a material formulated to provide electromagnetic shielding. Exemplary materials include plastics mixed with conductive material(s). Exemplary materials, methods, and structures provide the electromagnetic shielding while maintaining at least some surface electrical insulating properties for electrically isolating central conductor(s) from ground.

For example, thermoset plastics provide a matrix for immobilizing an electrical conductor such as a conductive metal, ferrite, carbon, carbon nanomaterial, and other materials known to skilled artisans as suitable materials. Frequently such electrical conductors will be finely divided however this is not necessary as, inter alia, encasement of conductors that are not finely divided within plastic will provide a shield. See also U.S. Pat. No. 4,783,279 filed Aug. 4, 1987 and U.S. Pat. No. 4,258,101 filed Aug. 4, 1978 each of which is incorporated herein in its entirety and for all purposes including in particular the disclosure of electromagnetic shielding.

In an embodiment, the mid radius wall 586 is formed from a thermoset plastic mixed with a finely divided conductor. In an embodiment, shielding additive concentration provides in a plastic structure that is not conductive. In an embodiment, the nose 506 is coated with an insulator such as an insulating paint.

Embodiments include a nose assembly 5001 having a nose 506 with an annular pocket 5012 surrounding connector and/or cable center conductor(s) wherein the annular pocket contains an electromagnetic shielding material. Any of the electromagnetic shield materials mentioned above may be used whether or not they are immobilized by a matrix material. In an embodiment, the pocket contains a finely divided conductor. In an embodiment, at least some of the pocket walls are coated with a shield material such as an acrylic coating pigmented with a high purity nickel flake (see e.g., MG Chemicals SuperShield™). In an embodiment, the pocket contains a cylindrical shield such as an electrically conductive cylinder, for example as a thin film aluminum cylinder. In some embodiments, the pocket contains a wire braid, mesh, or patterned fabric such as one of these materials rolled into a cylinder.

Embodiments include a nose 506 having a partial, substantially complete or complete outer covering enabling an electromagnetic shield. For example, the nose assembly 5001 of FIG. 5C shows an optional cap 5002 that might be formed by a number of different parts, coatings, laminates, and the like. Cap materials suitable for shielding include those mentioned above and those known to skilled artisans. In an embodiment, the cap is a metallic cap such as an aluminum cap.

The cap shown 5002 envelops the protruding nose 506 while providing a cap passage 5032 about coextensive with the nose passage 532 for receiving a center conductor of a mating connector (not shown). As the nose 506 moves in and out of the body end face aperture 509 and slides over the conductive pin 520, the cap moves together with it.

Figure 5D:
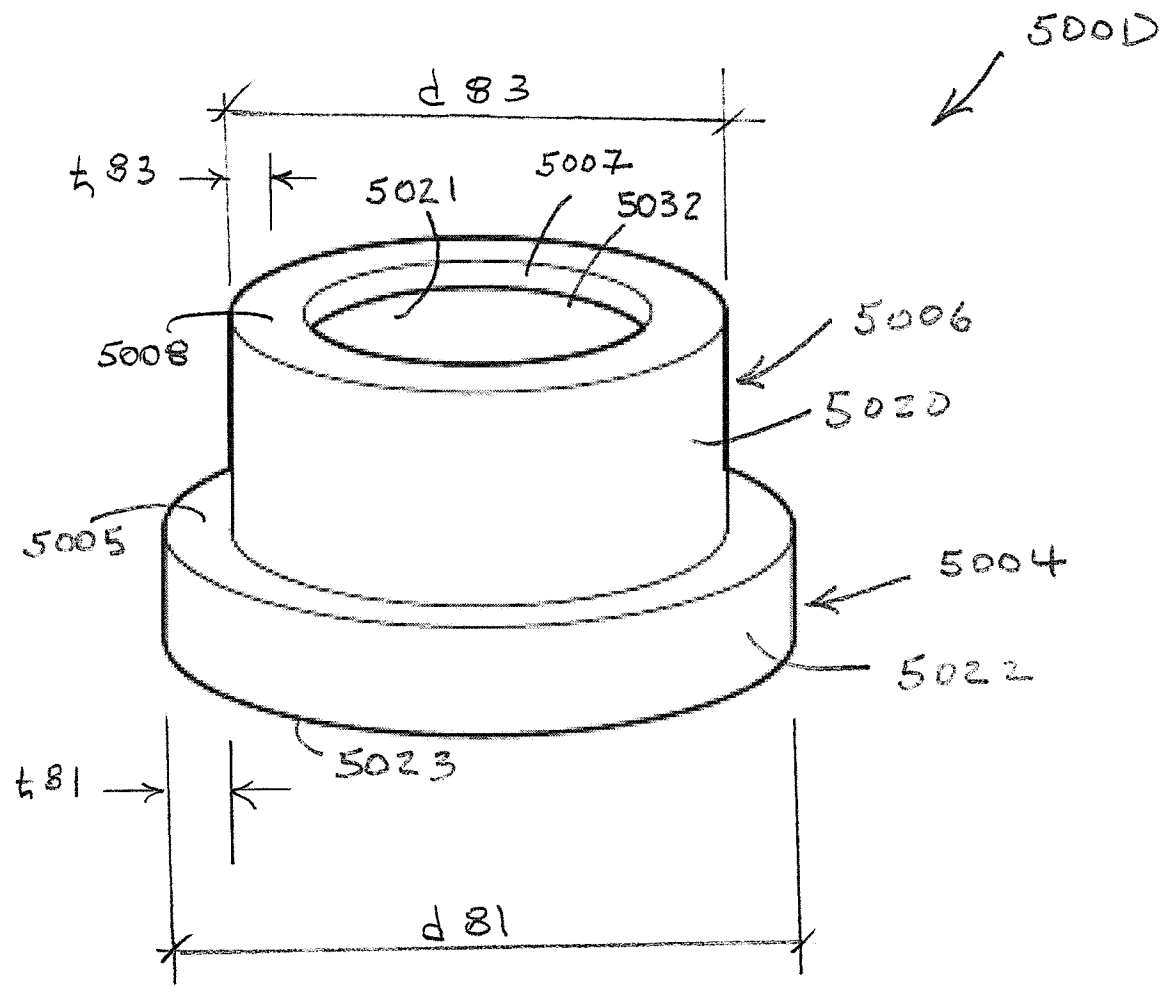

FIG. 5D shows a cap embodiment 500D. As shown, the cap has a base 5004 adjoining a cap projection 5006 with an end rim 5007 and end rim end face 5008. Smaller in diameter d83 than the base diameter d81, the cap projection meets the cap base as a cap shoulder 5005. In various embodiments, an installed cap has a base inside surface 5023 adjacent to the long radius wall OD 561, a base outside surface 5022 adjacent to a connector body inside wall 563, a projection inside surface 5021 adjacent to the mid range wall OD 571, and a projection outside surface 5020 slidably engaged with the body aperture 509. Measures t81 and t83 indicate wall thicknesses of the base and projection respectively.

In various ones of the embodiments described in connection with FIGS. 5C and 5D, an electromagnetic shield is formed around center conductor(s) of the cable and/or connector(s). This shield is carried with the nose such that electromagnetic shielding is not only enhanced when connectors are mated, shielding is also enhanced when the port of FIG. 5C is open and where a shield of length s71 isolates the connector center conductor including the conductive pin 520 and forward pin mouth 525 from unwanted RF signal ingress.

Figure 6A:
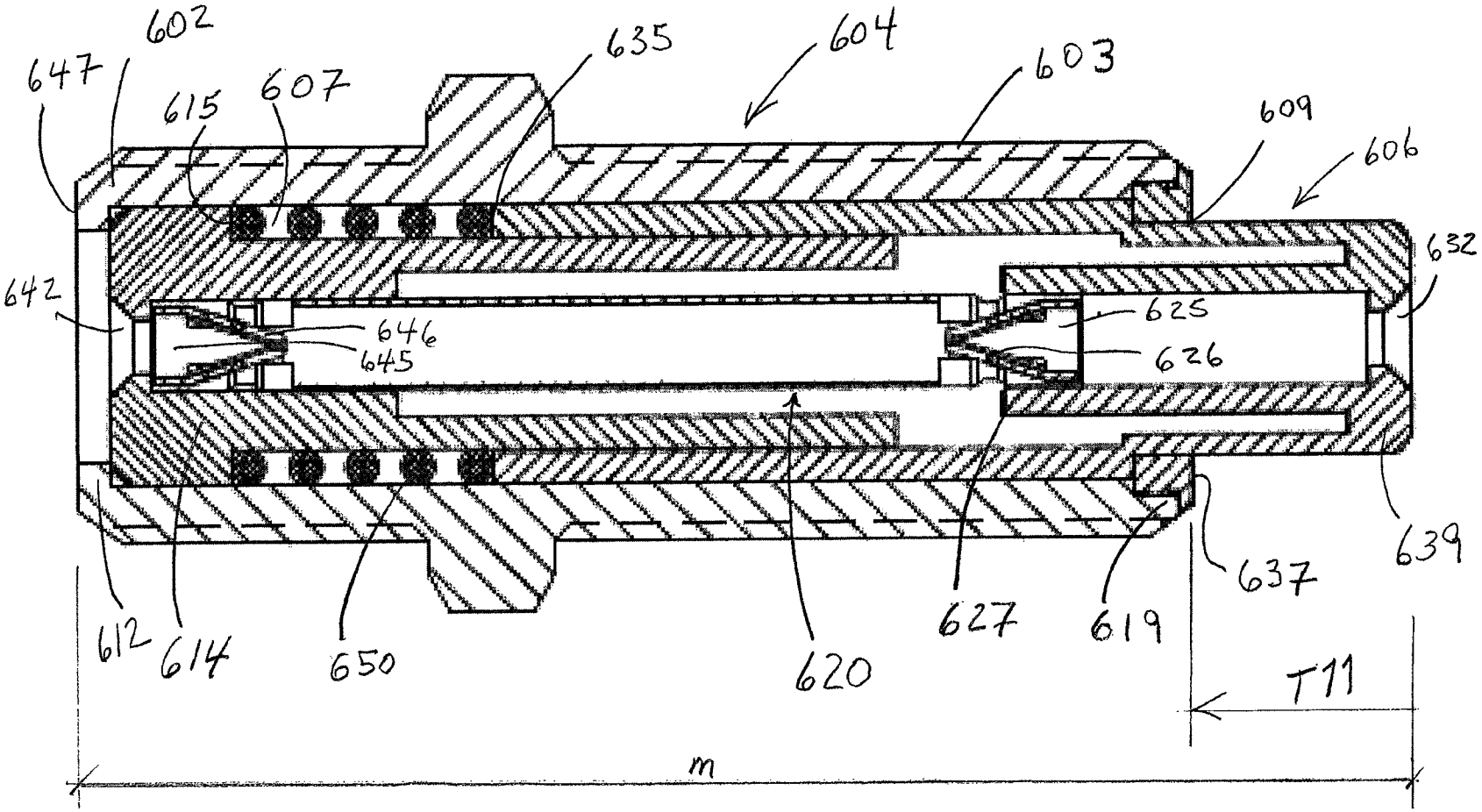
FIGS. 6A-D show an F connector splice in accordance with the present invention.
Figure 6B:
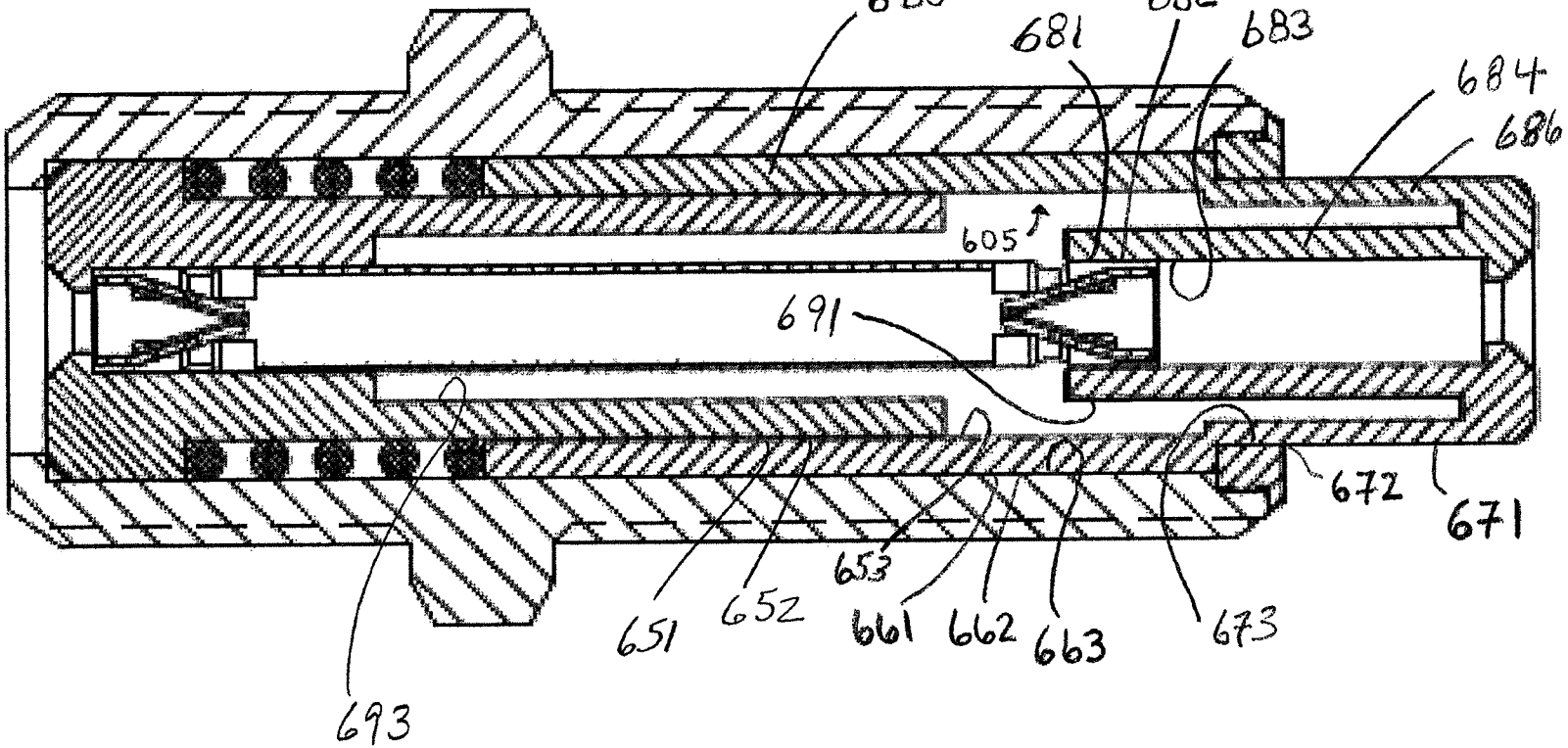

FIGS. 6A, 6B show an F connector splice with a spring activated nose 600A, 600B. A connector body 604 has external threads 603 and a moveable nose 606 that protrudes 639 from a body cavity 607 at a body forward end 619.

Within the body 604 is a trailing portion of the nose 605 and a socket stand 614. The trailing portion of the nose 605 slidably and/or telescopically engages the socket stand. In some embodiments, a body rim 612 partially closes the body cavity 607, for example to position the socket stand 614. An elastic medium and/or device such as a compressible spring 650 tends to push the nose 606 away from the end opposite the forward end 602 such that a protruding portion of the nose 639 extends from an aperture in the body end face 609. In an embodiment, the spring encircles the socket stand 614 such that it is between a nose rear-end 635 and a socket stand shoulder 615.

Centrally mounted within the body 604 is a conductive pin 620 having a forward pin mouth 625 with tines 626 and a trailing pin mouth 645 with tines 646. A nose passage in the protruding nose 632 enables a first coaxial cable center conductor (not shown) to access the pin mouth 625. A socket stand passage 642 enables a second coaxial cable center conductor (not shown) to access the opposed pin mouth 645. The forward pin mouth is slidingly inserted in a central socket of the nose 627 such that relative motion between the nose and the conductive pin occurs when the protruding nose 639 is pushed toward the socket stand 614. Notably, the distance between the nose end-face 637 and a connector opposed end face 647 (representing a connector length m is reduced when the spring 650 is compressed up to a distance T11.

In various embodiments, the nose 606 includes trailing walls such as a concentric short radius wall 684, mid radius wall 686, and long radius wall 688 forming portions of a plurality of sliding joints. For example plural of the following joints are formed in related embodiments. A forward joint 672 is formed between the mid-radius wall OD (outside diameter) 671 and a body forward end aperture lip 673. An inner central joint 682 is formed between the short radius wall ID (inside diameter) 683 and an outer surface of the pin mouth 681. An outer central joint 662 is formed between the long radius wall OD 661 and an inside wall of the body 663. A rear joint 652 is formed between the long radius wall ID 653 and a socket stand wall outer surface 651. An intermediate joint is formed between the mid radius wall OD 691 and an ID of the socket stand wall 693. As seen, a plurality of joints can be formed including: forward, inner central, outer central, rear, and intermediate joints.

Figure 6C:
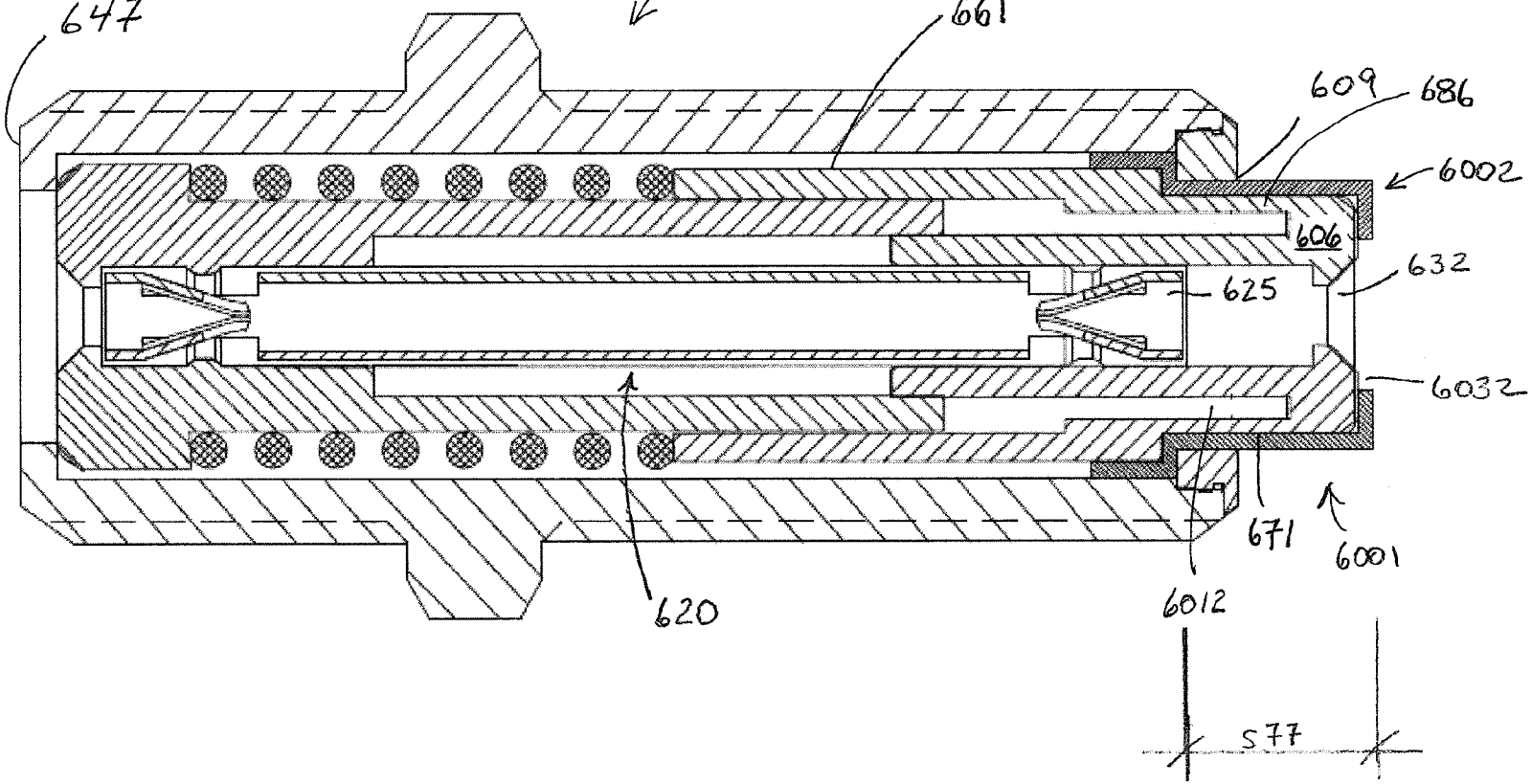

FIG. 6C shows 600C an enhanced version of an F connector splice of FIG. 6B. Here, embodiments of a nose assembly 6001 are configured to enhance electromagnetic shielding of center conductors.

In various embodiments, the nose assembly 6001 provides one or more of a) a nose 606 wholly or partially made from a material formulated to provide electromagnetic shielding, b) a nose 606 having an annular pocket 6012 surrounding connector and/or cable central conductor(s), the annular pocket containing an electromagnetic shielding material, and c) a nose 606 having a partial, substantially complete or complete outer covering that is an electromagnetic shield.

Embodiments include nose assemblies 6001 having a nose 606 wholly or partially made from a material formulated to provide electromagnetic shielding. Exemplary materials include plastics mixed with conductive material(s). Exemplary materials, methods, and structures provide the electromagnetic shielding while maintaining at least some surface electrical insulating properties for electrically isolating central conductor(s) from ground.

For example, thermoset plastics provide a matrix for immobilizing an electrical conductor such as a conductive metal, ferrite, carbon, carbon nanomaterial, and other materials known to skilled artisans as suitable materials. Frequently such electrical conductors will be finely divided however this is not necessary as, inter alia, encasement of conductors that are not finely divided within plastic will provide a shield.

In an embodiment, the mid radius wall 686 is formed from a thermoset plastic mixed with a finely divided conductor. In an embodiment, shielding additive concentration provides in a plastic structure that is not conductive. In an embodiment, the nose 606 is coated with an insulator such as an insulating paint.

Embodiments include a nose assembly 6001 having a nose 606 with an annular pocket 6012 surrounding connector and/or cable center conductor(s) wherein the annular pocket contains an electromagnetic shielding material. Any of the electromagnetic shield materials mentioned above may be used whether or not they are immobilized by a matrix material. In an embodiment, the pocket contains a finely divided conductor. In an embodiment, at least some of the pocket walls are coated with a shield material such as an acrylic coating pigmented with a high purity nickel flake (see e.g., MG Chemicals SuperShield™). In an embodiment the pocket contains a cylindrical shield such as an electrically conductive cylinder, for example as a thin film aluminum cylinder. In some embodiments, the pocket contains a wire braid, mesh, or patterned fabric such as one of these materials rolled into a cylinder.

Embodiments include a nose 606 having a partial, substantially complete or complete outer covering enabling an electromagnetic shield. For example, the nose assembly 6001 of FIG. 6C shows an optional cap 6002 that might be formed by a number of different parts, coatings, laminates, and the like. Cap materials suitable for shielding include those mentioned above and those known to skilled artisans. In an embodiment, the cap is a metallic cap such as an aluminum cap.

The cap shown 6002 envelops the protruding nose 606 while providing a cap passage 6032 about coextensive with the nose passage 632 for receiving a center conductor of a mating connector (not shown). As the nose 606 moves in and out of the body end face aperture 609 and slides over the conductive pin 620, the cap moves together with it.

Figure 6D:
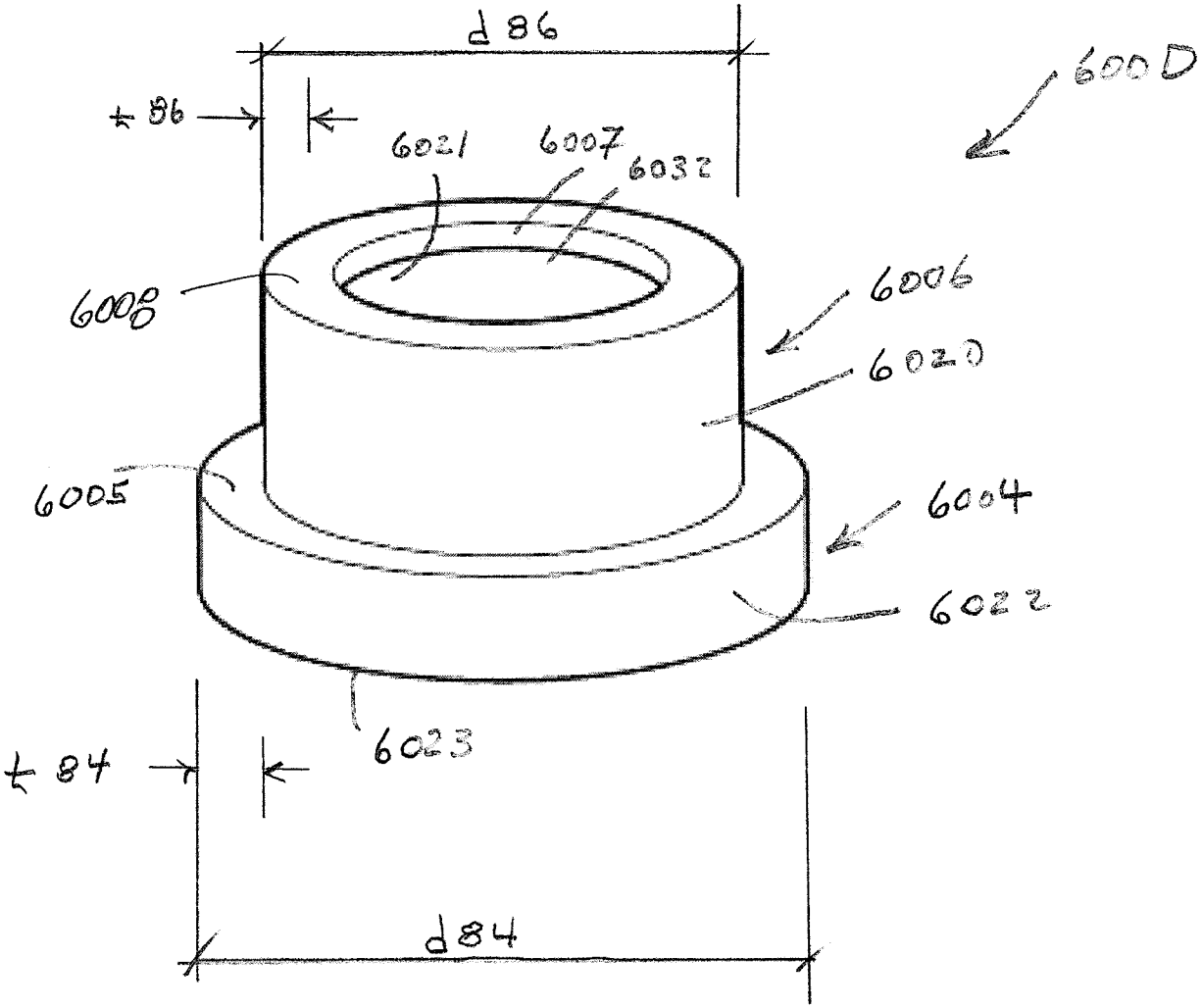

FIG. 6D shows a cap embodiment 600D. As shown, the cap has a base 6004 adjoining a cap projection 6006 with an end rim 6007 and end rim end face 6008. Smaller in diameter d86 than the base diameter d84, the cap projection meets the cap base as a cap shoulder 6005. In various embodiments, an installed cap has a base inside surface 6023 adjacent to the long radius wall OD 661, a base outside surface 6022 adjacent to a connector body inside wall 663, a projection inside surface 6021 adjacent to the mid range wall OD 671, and a projection outside surface 6020 slidably engaged with the body aperture 609. Measures t84 and t86 indicate wall thicknesses of the base and projection respectively.

In various ones of the embodiments described in connection with FIGS. 6C and 6D, an electromagnetic shield is formed around center conductor(s) of the cable and/or connector(s). This shield is carried with the nose such that electromagnetic shielding is not only enhanced when connectors are mated, shielding is also enhanced when the port of FIG. 6C is open and where a shield of length s77 isolates the connector center conductor including the conductive pin 620 and forward pin mouth 625 from unwanted RF signal ingress.

Figure 7A:
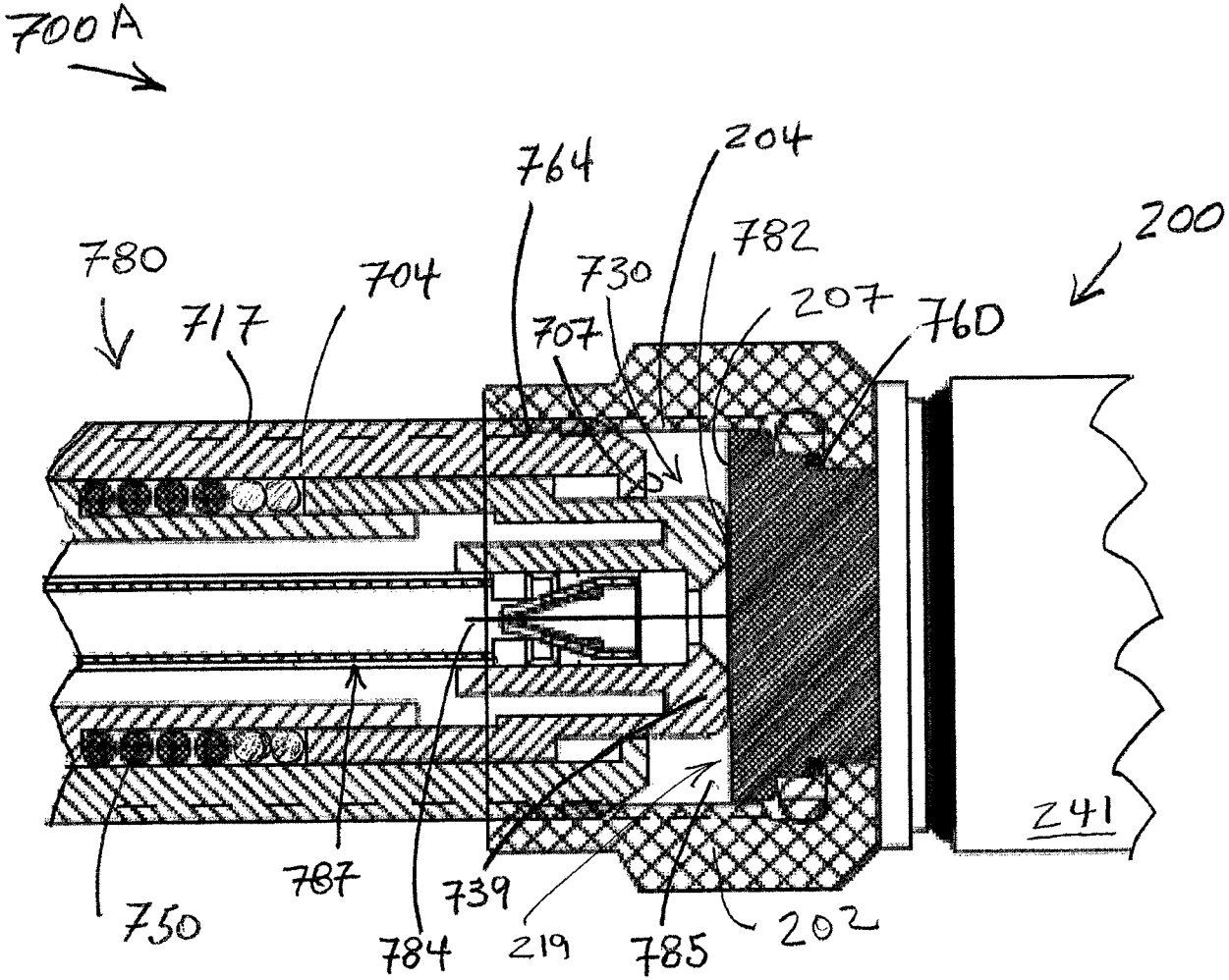
FIG. 7A shows a first example of a mated female F connector in accordance with the present invention.
Figure 7B:
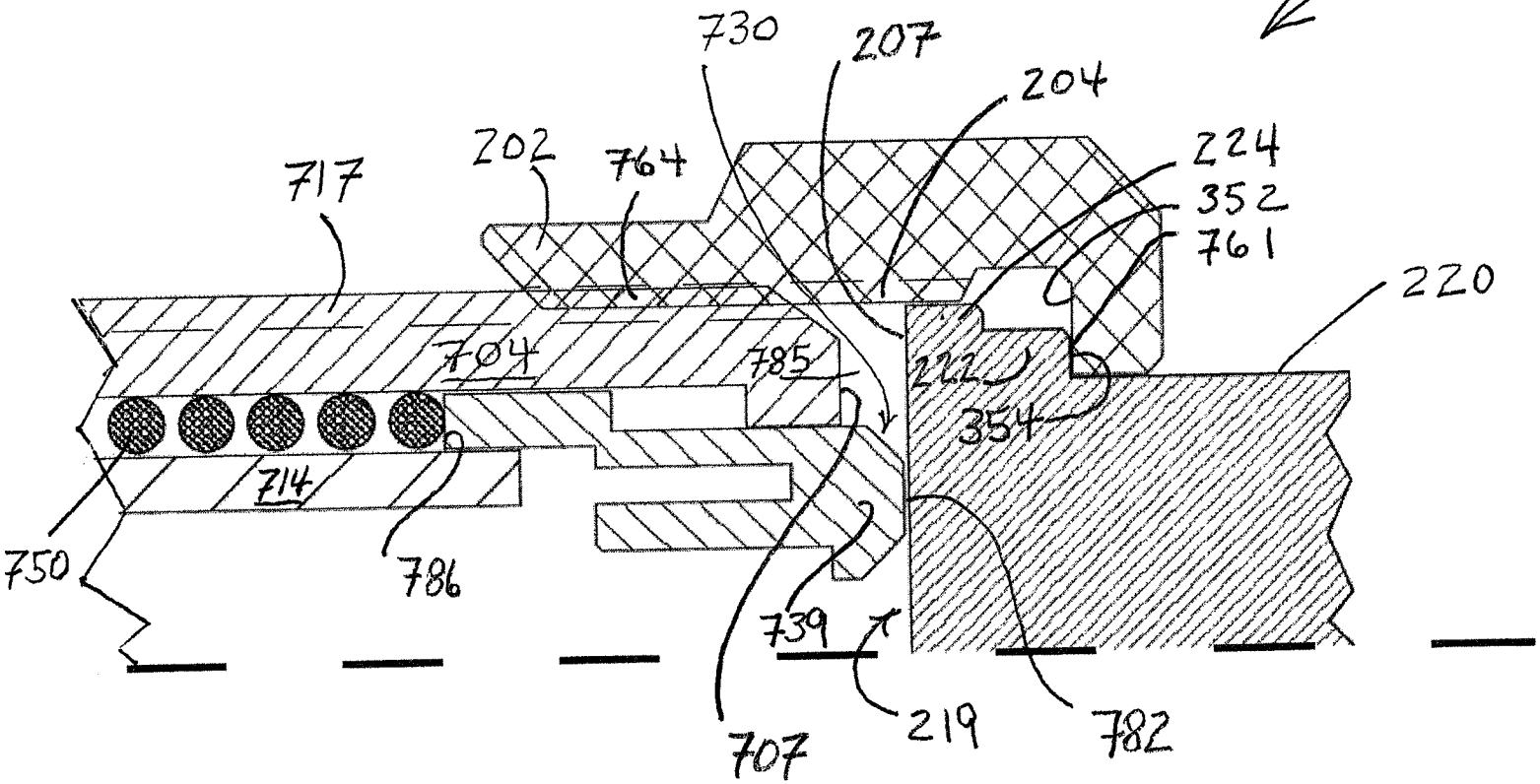
FIG. 7B shows an enlarged portion of FIG. 7A.
Figure 7C:
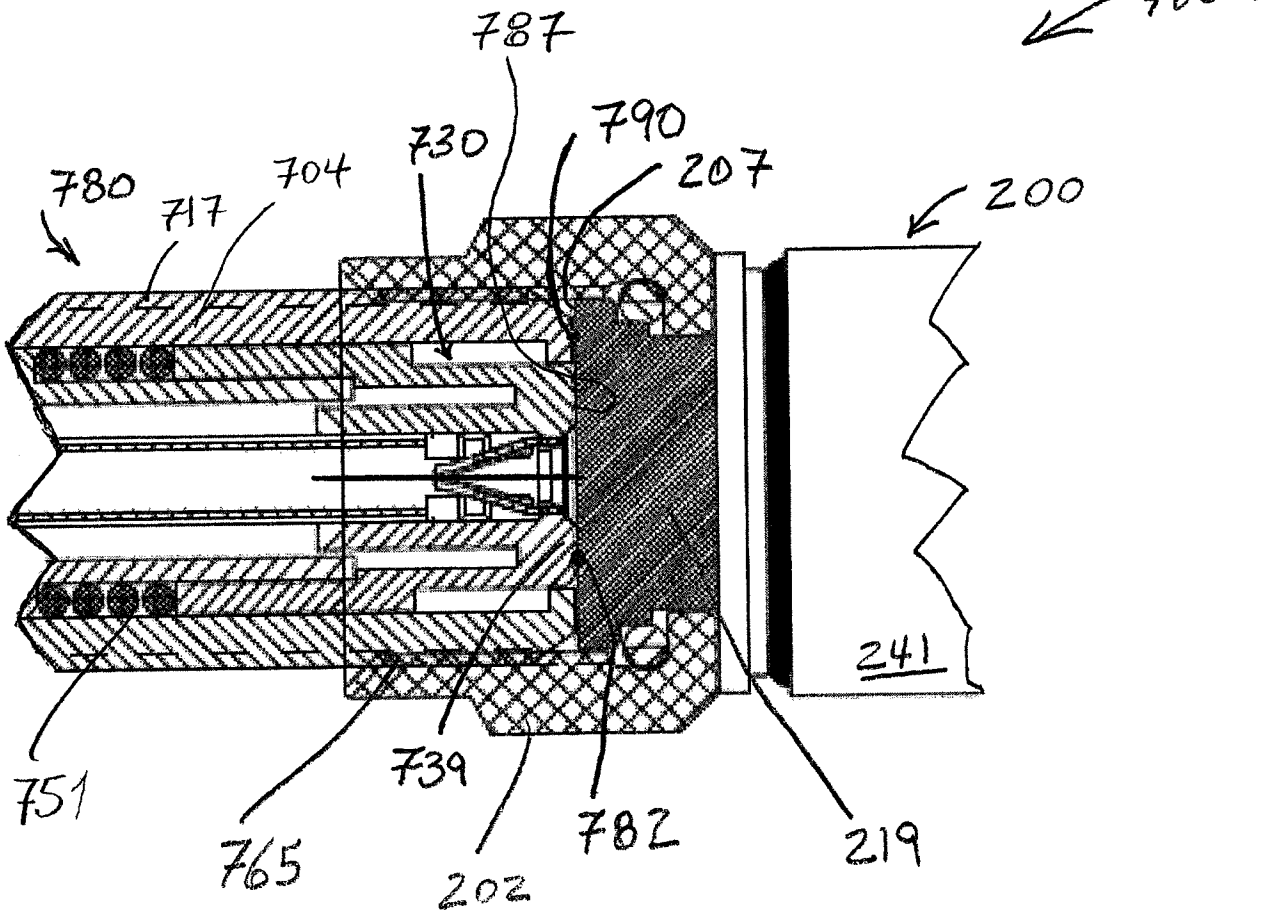
FIG. 7C shows a second example of a mated female F connector in accordance with the present invention.

FIG. 7A shows a male F connector that is engaged, but partially mated with a female F connector including a spring activated nose 700A. FIG. 7B shows an enlarged view 700B of engagement portions of the mated connectors of FIG. 7A. FIG. 7C shows complete mating 700C of the male and female F connectors of FIG. 7A.

As skilled artisans will recognize, F connectors of various sorts other than those described above can benefit from embodiments of the present invention. For example, nose actuating springs need not be located within a connector body. Embodiments having female coaxial connectors that are part of a larger device may, for example, have a nose actuating spring located outside the connector body. Examples include a spring located on the device but apart from the connector body.

In FIG. 7A, a male F connector 200 is engaged and partially mated with a female F connector portion 780. External threads 717 of the female connector 780 are engaged 764 with internal threads 204 of the male connector nut 202. As shown, the engagement provides only a partial mating as seen by the gap 785 between the female connector end face 707 and the flange face 207 of the male connector mandrel 219.

However, unlike prior art connectors, the male connector 200 is nevertheless urged away from the female connector 780 by the spring actuated nose 730. Forces tending to separate the connectors are exchanged at a nose/mandrel contact 782 where the nose 730 meets the mandrel face 207. Resisting the tendency of the nose to push the connectors apart is a first nut engagement where nut and body threads are urged to interengage 764 and a second nut engagement where the nut rim front face is urged to contact the mandrel shoulder back face 760.

As persons of ordinary skill in the art will appreciate, a tendency of the nose to hold partially mated connectors apart improves the electromagnetic containment surrounding coaxial cable central conductor(s) 784 and conductive center pin(s) 787. In particular, spring rate (k [kg/mm]) and spring compression (d [mm]) will determine and/or influence strongly the degree of contact and contact forces developed at the nut engagements 764, 760 of partially mated connectors. In various embodiments, connector geometry and values of k and d are chosen to reduce ingress of unwanted signals into mated connectors by amounts ranging from 3 to 40 decibels.

FIG. 7B shows an enlarged view 700B of the nose contact and nut engagements of the partially mated connectors of FIG. 7A. As seen, the protruding portion of the nose 739 extends from the female connector body 704 and contacts 782 the mandrel flange face 207. The spring 750 encircles a stand-like portion 714 and pushes against a nose back face 786. The female connector external body threads 717 interengage 764 with the nut internal threads 204. In some embodiments, the mandrel shoulder back face 354 contacts 761 the forward face of the nut rim 352 (as shown).

FIG. 7C shows the male and female connectors of FIG. 7A after they are engaged and completely complete mated 700C. As seen, the protruding nose portion 739 no longer protrudes from the female connector body 704. Rather, the end face of the protruding nose 787 is about flush with the end face of the body 707, the protruding nose end face 787 contacts 782 the mandrel flange face 207, and the body end face 707 contacts 790 the mandrel flange face 207. As persons of ordinary skill in the art will recognize, contact between the female connector body and the male connector mandrel enhances electrical continuity between the shield or ground of the male connector and the shield or ground of the female connector.

Notably, when the protruding nose is pressed into the female connector body, the spring 751 is compressed and the gap 785 is closed or substantially closed, male-female connector thread engagement 765 is tightened, and the nut rim front face 352 is tightly engaged with the mandrel shoulder back face 354.

As can be seen, tightly mated male and female connectors 200, 780 provide for enhanced electromagnetic containment of connector center pin(s) 787 and corresponding conductor(s) of coaxial cable(s). In lieu of tight mating, embodiments of the present invention enhance the stray signal rejection capabilities of loosely engaged connectors benefitting from the spring actuated nose.

Figure 8A:
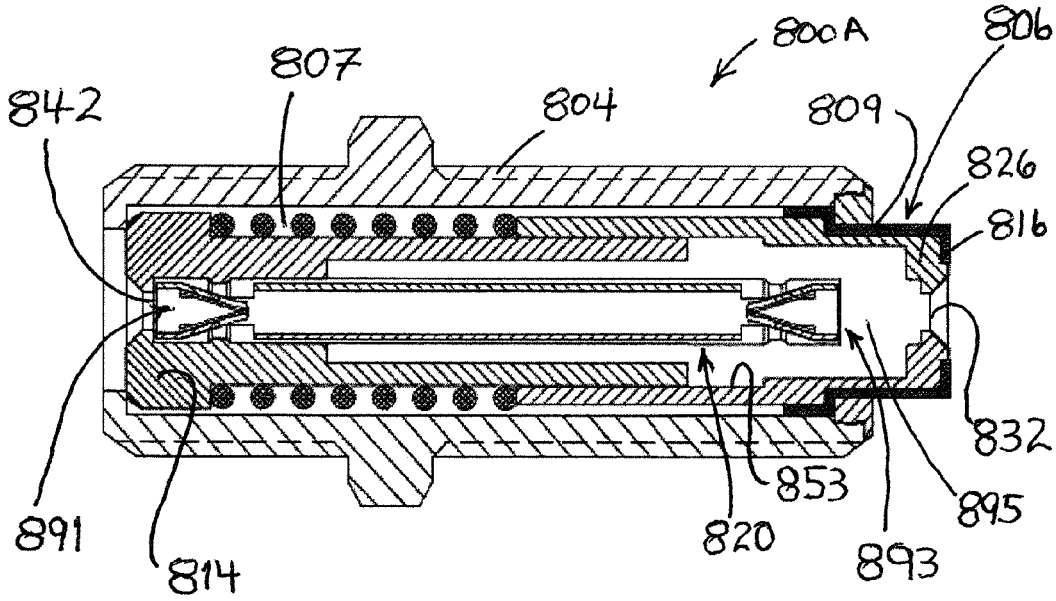
FIGS. 8A-B show F connector splices in accordance with the present invention.
Figure 8B:
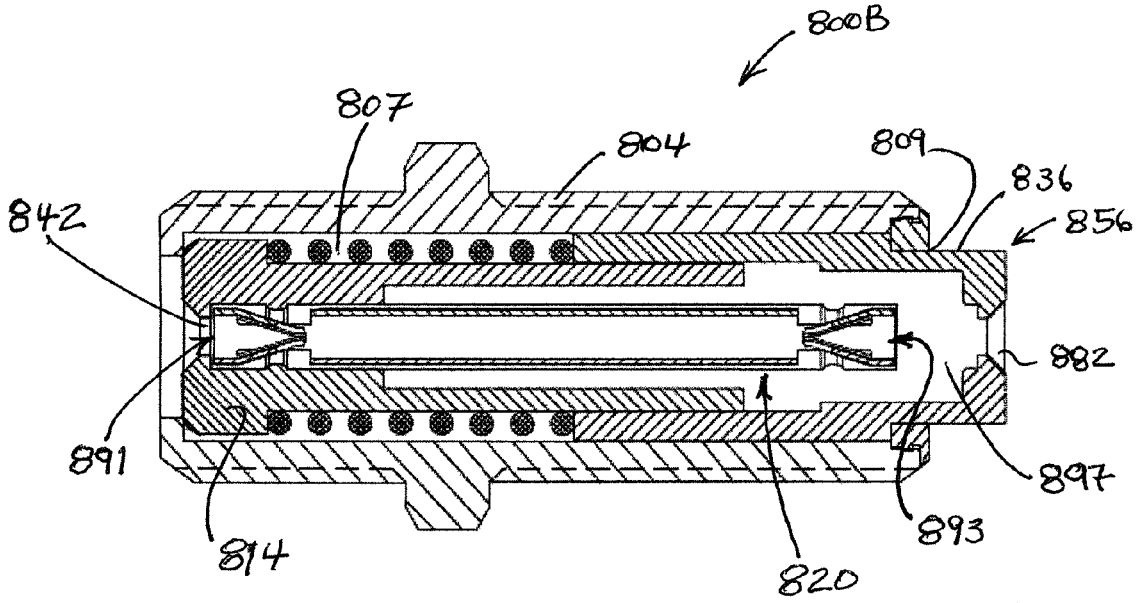

FIGS. 8A-B show F connector splices 800A, 800B. In particular, in similar fashion to FIGS. 6A-C, a connector body 804 receives into a connector body cavity 807 a socket stand 814 and a moveable nose 806. In some embodiments, the moveable nose includes a bore 853 for telescopic arrangement with the socket stand. The moveable nose protrudes from a body end face aperture 809. Passages in the socket stand 842 and moveable nose 832, 882 are for receiving a center conductor of a coaxial cable. As shown, the passages provide access to a conductive pin 820 that is about centrally located in the body cavity. A first end of the conductive pin 891 is supported by the socket stand while an opposed second end of the conductive pin 893 extends into an area of the movable nose such as a cavity 895, 897 of the nose 806, 856. In various embodiments, the second end of the conductive pin is not supported by the moving nose. And, in various embodiments, the second end of the conductive pin is cantilevered (as shown).

FIG. 8A shows the moveable nose 806 having a nose base such as a non-magnetically shielding nose base 826 inserted in an electro-magnetically shielding nose cap such as a metallic nose cap 816. Moving with the nose, the nose cap shields the adjacent conductive pin end 893, particularly when no connector is mated with the movable nose end of the splice 809.

FIG. 8B shows the moveable nose 856 with electromagnetic nose part shielding 836 in all of or in a portion of the nose. In various embodiments the nose part may be treated to provide magnetic shielding and in various embodiments the nose part is coextensive with the moveable nose. Treatments may include surface treatments such as coatings, platings, and embedments. Treatments may also include magnetically shielding portions of a mixture from which the nose part is made. For example, finely divided metal(s) may be suspended in a polymer substrate to provide at least a portion of the nose part with the desired shielding properties. Understandably, skilled artisans will, upon seeing applicant's disclosure, recognize other embodiments that implement applicant's teaching. For example, FIGS. 8A-B may be modified according to applicant's related teaching above.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A moving part coaxial cable connector comprising:
a connector body with first and second ends;
an aperture at the connector body first end;
a nose urged to project from the aperture by a nose projecting spring;
a stop for limiting movement of the nose relative to the body;
the nose movable in the aperture according to external forces;
a conductive center pin and an adjoining pin mouth end;
an electromagnetic shield incorporated in the nose; and,
wherein one or more connector center conductors are shielded when the connector is unmated and the nose is free to project from the aperture.

2. The connector of claim 1 further comprising:
a central passageway of the nose and the adjoining pin mouth end slidably in the central inserted therein.

3. The connector of claim 1 further comprising:
a terminal for fixing a coaxial cable at one end of the connector; and,
wherein the connector is a female F connector port.

4. The connector of claim 1 further comprising:
a bore extending between the connector body first and second ends;
at the connector body second end, a connection for a male F connector; and,
wherein the connector is an F splice.

5. A moving part coaxial cable connector comprising:
a connector body with first and second ends;
an aperture at the connector body first end;
a nose urged to project from the aperture by a spring;
the spring having a design and spring constant able to project the nose when the connector is not mated;
the spring having a design and spring constant able to mate connector ground path parts when the connector is mated;
the nose movable in the aperture according to external forces;
a conductive center pin and an adjoining pin mouth end, the pin mouth end slidably inserted in a central passageway of the nose;
the spring and the conductive center pin in coaxial alignment;
an electromagnetic shield incorporated in the nose;
wherein when the connector is unmated, one or more connector center conductors are shielded when the nose freely projects from the aperture; and,
wherein when the connector is mated, the nose is operable to urge the separation of a mated male F connector such that mating of connector ground path parts is improved.

6. The connector of claim 5 further comprising:
a terminal for fixing a coaxial cable at one end of the connector; and,
wherein the connector is female F connector port.

7. The connector of claim 5 further comprising:
at the connector body second end, a connection for a male F connector; and,
wherein the connector is an F splice.

8. The connector of claim 5 further comprising a conductive pin fixing structure for preventing relative motion between the pin and the female F connector body.

9. The connector of claim 5 further comprising a cylindrical structure and a pin mouth that make up all or a portion of the conductive center pin.

10. The connector of claim 5 wherein the cylindrical structure is concentric about a line whose length is the shortest distance between its end points.

11. A method of mating coaxial connectors for improving continuity and electromagnetic shielding, the method comprising the steps of:
providing a female connector body with a central cavity extending between first and second ends of the body;
extending a nose incorporating an electromagnetic shield from a first end of the body;
the body and the nose in coaxial alignment;
biasing the nose to extend from the body;
engaging the body with a mating male connector;
reducing a gap between the connectors by advancing a nut of the male connector on the female connector;
the extended nose urging separation of the mated connectors;
wherein the separation urged improves electrical contact between mated connector parts included in the ground path of the mated connectors; and,
wherein the separation urged tends to close gaps in the containment enclosing the central signal path of the mated connectors.

12. The mating method of claim 11 further comprising the step of:
fixing a conductive pin to the female F connector body to prevent relative motion between the pin and the female F connector body.

13. The mating method of claim 11 further comprising the step of:
forming the conductive pin as a cylindrical structure with a pin mouth.

14. The mating method of claim 13 further comprising the step of:
forming the conductive pin as a straight conductive pin.

* * * * *